US009151054B2

(12) United States Patent
Gulikov

(10) Patent No.: US 9,151,054 B2
(45) Date of Patent: Oct. 6, 2015

(54) STEEL REINFORCING STRUCTURE FOR CONCRETE

(71) Applicant: Alexee Anatolievich Gulikov, Ingleburn (AU)

(72) Inventor: Alexee Anatolievich Gulikov, Ingleburn (AU)

( * ) Notice: Subject to any disclaimer, the term of this patent is extended or adjusted under 35 U.S.C. 154(b) by 0 days.

(21) Appl. No.: 14/359,147

(22) PCT Filed: Oct. 31, 2012

(86) PCT No.: PCT/AU2012/001329

§ 371 (c)(1),
(2) Date: May 19, 2014

(87) PCT Pub. No.: WO2013/071338

PCT Pub. Date: May 23, 2013

(65) Prior Publication Data

US 2014/0260037 A1 Sep. 18, 2014

(30) Foreign Application Priority Data

Nov. 20, 2011 (AU) ..... 2011904837

(51) Int. Cl.
*E04C 5/00* (2006.01)
*E04C 5/06* (2006.01)

(52) U.S. Cl.
CPC ..... *E04C 5/0645* (2013.01); *E04C 5/0618* (2013.01)

(58) Field of Classification Search
CPC ..... E04C 5/04; E04C 5/06–5/0622; E04C 5/0645; E04C 3/20; E04C 3/34
See application file for complete search history.

(56) References Cited

U.S. PATENT DOCUMENTS 3,245,190 A * 4/1966 Reiland ..... 52/649.3
3,375,632 A * 4/1968 Congy ..... 52/649.3
3,744,207 A * 7/1973 Oroschakoff ..... 52/664
6,293,071 B1 * 9/2001 Konstantinidis ..... 52/659
2004/0231278 A1 * 11/2004 Yin ..... 52/649.4
2004/0237449 A1 * 12/2004 Gulikov ..... 52/633

FOREIGN PATENT DOCUMENTS

CN 200978488 Y 11/2007
DE 3938508 A1 * 10/1990 ..... B21F 27/10
GN 2880964 Y 3/2007
JP 3116896 U * 12/2005
WO WO 2013071338 A1 * 5/2013

OTHER PUBLICATIONS

International Preliminary Report on Patentability of Mar. 13, 2014 in PCT/AU2012/001329.

* cited by examiner

*Primary Examiner* — Christine T Cajilig
(74) *Attorney, Agent, or Firm* — Young Law Firm, P.C.

(57) ABSTRACT

The present invention relates generally to a steel reinforcing structure 10 for concrete according to one embodiment of the invention. The steel reinforcing structure is in the form of a cage 10 comprising six (6) reinforcing bars arranged substantially parallel to one another including a pair of common reinforcing bars 12A and 126 located intermediate two (2) pairs of opposing reinforcing bars 14A/B and 16A/B. The reinforcing cage 10 also comprises a plurality of spiral ties including one pair of spiral ties 18A and 18B located on one side of the reinforcing cage 10, and another pair of spiral ties 20A and 20B located on an opposite side of the reinforcing cage 10. The pair of spiral ties 18A/18B on the left hand side of the reinforcing cage 10 are formed in a clockwise direction whereas the other pair of spiral ties 20A/20B on the right hand side of the reinforcing cage 10 are formed in an anticlockwise direction forming a set of the spiral ties. This opposing orientation of the spiral ties such as 18A and 20A is understood to balance loads and stresses in the reinforcing cage 10 which may otherwise twist or distort.

27 Claims, 6 Drawing Sheets

STEEL REINFORCING STRUCTURE FOR CONCRETE

CROSS-REFERENCE TO RELATED APPLICATIONS

This application is a 35 U.S.C. §371 US National Phase application of International Patent Application PCT/AU2012/001329 having an International Filing Date of 31 Oct. 2012, Which claims priority to AU application 2011904837 filed on Nov. 20, 2011, which applications are incorporated herein by reference in their entireties and from which priority is hereby claimed under 35 U.S.C. §120.

FIELD OF THE INVENTION

The present invention relates broadly to a steel reinforcing structure for concrete. The invention also relates generally to a method of forming a steel reinforcing structure for concrete.

BACKGROUND TO THE INVENTION

In a reinforced concrete structure, steel reinforcing is embedded in cast concrete. The steel reinforcing can be prefabricated or constructed in-situ in the form of a reinforcing cage. The steel reinforcing cage is located inside formwork within which concrete is poured. The formwork may be temporary and removed once the concrete has set or the formwork may remain as an integral part of the reinforced concrete structure. The steel reinforcing provides the concrete structure with tensile strength and complements the compressive strength of the concrete. However, the steel reinforcing cage can distort or twist causing unnecessary deflection of the resulting reinforced concrete structure.

SUMMARY OF THE INVENTION

According to one aspect of the present invention there is provided a steel reinforcing structure for concrete, said structure comprising:

- at least a pair of opposing reinforcing bars arranged substantially parallel to one another;
- at least one common reinforcing bar located intermediate and substantially parallel to the pair of opposing reinforcing bars;
- a spiral tie at one end connected to one of the pair of opposing reinforcing bars at a first position and formed in a clockwise direction around the common reinforcing bar to connect at an opposite end of the spiral tie to said one of the pair of opposing reinforcing bars at another position offset longitudinally from said first position;
- an other spiral tie at one end connected to the other of the pair of opposing longitudinal reinforcing bars at a second position and formed in an anticlockwise direction around the common reinforcing bar to connect at an opposite end of the other spiral the to said other of the pair of opposing reinforcing bars at a further position offset longitudinally from said second position.

Preferably the steel reinforcing structure also comprises a further spiral tie at one end connected to the common reinforcing bar at a third position laterally opposite the first position and formed in the clockwise direction around said one of the pair of reinforcing bars to connect at an opposite end of the further spiral tie to said common reinforcing bar at yet another position offset longitudinally from the third position. More preferably the other position is laterally opposite said yet another position. Even more preferably said structure further comprises yet another spiral tie at one end connected to the common reinforcing bar at a fourth position laterally opposite the second position and formed in the anticlockwise direction around the other of the pair of reinforcing bars to connect at an opposite end of said yet another spiral tie to said common reinforcing bar at still a further position offset longitudinally from the fourth position.

According to another aspect of the invention: there is provided a steel reinforcing structure for concrete, said structure comprising:

- at least a pair of opposing reinforcing bars arranged substantially parallel to one another;
- at least one common reinforcing bar located intermediate and substantially parallel to the pair of opposing reinforcing bars;
- a spiral tie at one end connected to the common reinforcing bar at a first position and formed in a clockwise direction around one of the opposing pair of reinforcing bars to connect at an opposite end of the spiral tie to the common reinforcing bar at another position offset longitudinally from the first position;
- an other spiral tie at one end connected to the common reinforcing bar at a second position and formed in an anticlockwise direction around the other of the opposing pair of reinforcing bars to connect at an opposite end of the other spiral tie to the common reinforcing bar at a further position offset longitudinally from the second position.

Preferably the steel reinforcing structure further comprises a further spiral tie at one end connected to said one of the opposing pair of reinforcing bars at a third position laterally opposite the first position and formed in the clockwise direction around the common reinforcing bar to connect at an opposite end of the further spiral tie to said one of the pair of reinforcing bars at yet another position offset longitudinally from the third position. More preferably the other position is laterally opposite said yet another position. Even more preferably said structure further comprises yet another spiral tie at one end connected to said other of the opposing pair of reinforcing bars at a fourth position laterally opposite the second position and formed in the anticlockwise direction around the common reinforcing bar to connect at an opposite end of said yet another spiral tie to said other of the pair of the reinforcing bars at still a further position offset longitudinally from the fourth position.

Preferably the spiral ties each form about the common reinforcing bar and either one or the other of the opposing pair of reinforcing bars in a single rotation. More preferably the first position at which the spiral tie is connected to either said one of the pair of reinforcing bars or the common reinforcing bar is substantially the same as the second position at which the other spiral tie is connected to either the other of the pair of reinforcing bars or the common reinforcing bar. Even more preferably the third position is substantially the same as the fourth position. Still more preferably the other position is substantially the same as the further position. Even still more preferably said yet another position is laterally opposite said still a further position.

Preferably each of the pair of opposing reinforcing bars is one of two reinforcing bars arranged substantially parallel to one another, and the common reinforcing bar is one of two common reinforcing bars also arranged substantially parallel to one another. More preferably the two reinforcing bars from each of the pairs are equally spaced laterally from and substantially aligned with the two common reinforcing bars. Alternatively the common reinforcing bar is one of two common reinforcing bars arranged substantially parallel to one another, and each of the pair of opposing reinforcing bars is a single reinforcing bar equally spaced laterally from the two common reinforcing bars. Still alternatively the single reinforcing bars are equally spaced laterally from and substantially aligned with one only of the two common reinforcing bars. Still more alternatively the common reinforcing bar is a single common reinforcing bar, and each of the pair of opposing reinforcing bars is one of two reinforcing bars arranged substantially parallel to one another and equally spaced laterally from the single common reinforcing bar.

Preferably the spiral ties are each one of a plurality of spiral ties spaced longitudinally along respective of either said one or the other of the pair of reinforcing bars, and the common reinforcing bar. More preferably each of the plurality of spiral ties forms about the common reinforcing bar and either one or the other of the opposing pair of reinforcing bars in a single rotation.

According to a further aspect of the invention there is provided a method of forming a steel reinforcing structure for concrete, said method comprising the steps of:

- providing at least a pair of opposing reinforcing bars arranged substantially parallel to one another;
- providing at least one common reinforcing bar located intermediate and substantially parallel to the pair of opposing reinforcing bars;
- interconnecting the pair of opposing reinforcing bars and the common reinforcing bar by:
  - i) connecting a spiral tie at one end to one of the pair of opposing reinforcing bars, or the common reinforcing bar, at a first position;
  - ii) forming the spiral tie in a clockwise direction around the common reinforcing bar, or said one of the pair of opposing reinforcing bars;
  - iii) connecting the spiral tie at an opposite end to said one of the pair of opposing reinforcing bars, or the common reinforcing bar, at another position offset longitudinally from the first position;
  - iv) connecting an other spiral tie at one end to the other of the pair of opposing reinforcing bars, or the common reinforcing bar, at a second position;
  - v) forming the other spiral tie in an anticlockwise direction around the common reinforcing bar, or the other of the pair of opposing reinforcing bars;
  - vi) connecting the other spiral tie at an opposite end to said other of the pair of opposing reinforcing bars, or the common reinforcing bar, at a further position offset longitudinally from the second position.

Preferably the step of connecting the spiral tie or the other spiral tie involves welding said spiral tie to either one of the pair of opposing reinforcing bars or the common reinforcing bar. Alternatively or additionally this connecting step involves bending or crimping said spiral tie to secure it to either one of the pair of reinforcing bars or the common reinforcing bar. Alternatively the spiral tie is wired or chemically bonded to said one of the reinforcing bars or the common reinforcing bar.

Preferably the pair of reinforcing bars and/or the common reinforcing bar are deformed bars. More preferably the spiral ties are smooth tie rods.

Preferably the steel reinforcing structure is in the form of a steel reinforcing cage to be embedded in cast concrete. More preferably the steel reinforcing cage embedded in cast concrete is in the form of a column, pier, arch, beam, truss, floor, ceiling or wall.

BRIEF DESCRIPTION OF THE DRAWINGS

In order to achieve a better understanding of the nature of the present invention a preferred embodiment of a steel reinforcing structure for concrete will now be described, by way of example only, with reference to the accompanying drawings in which.

DETAILED DESCRIPTION OF THE PREFERRED EMBODIMENTS

Figure 1:
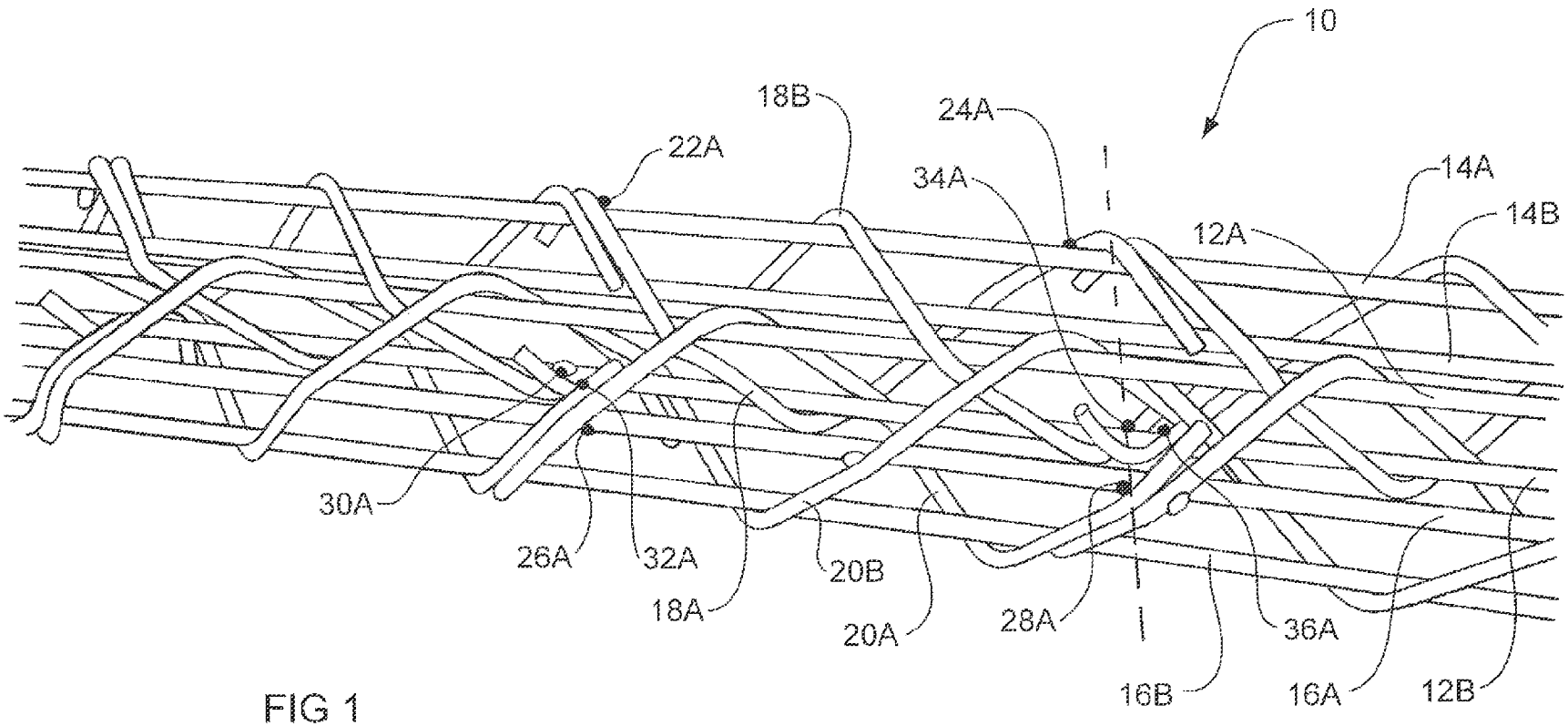
FIG. 1 is a perspective and enlarged view of one embodiment of a steel reinforcing structure for concrete according to the invention.
Figure 2:
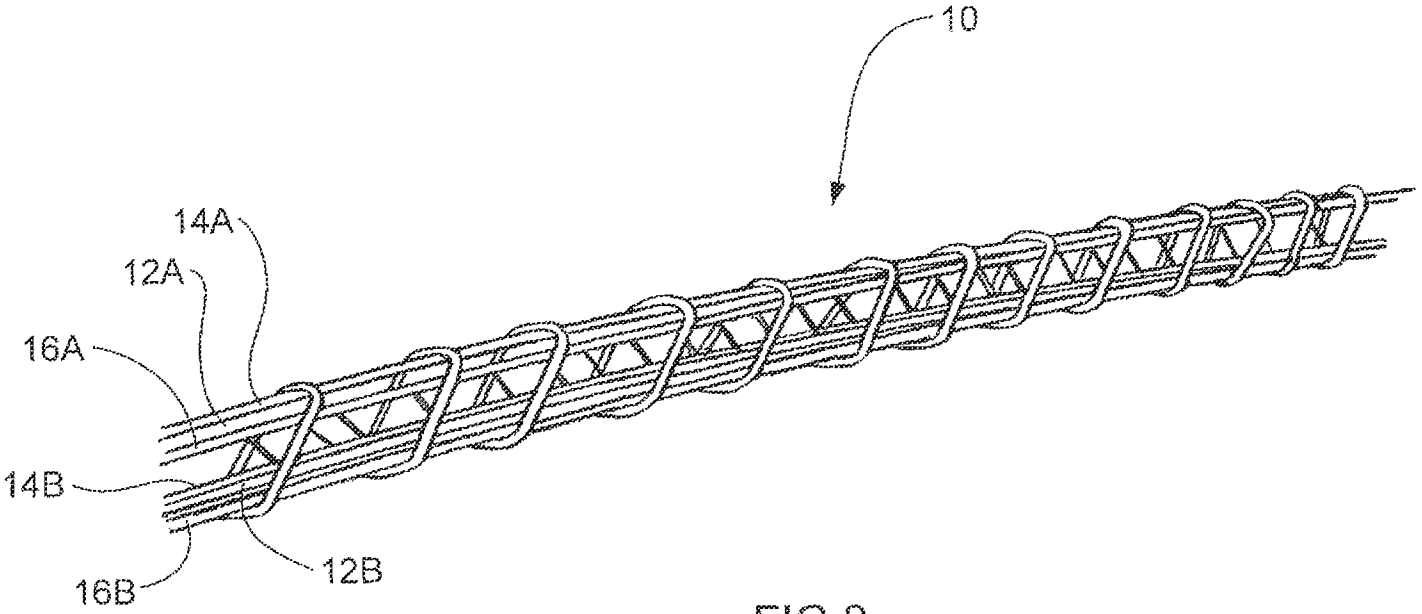
FIG. 2 is a perspective view of a steel reinforcing cage such as that formed from the steel reinforcing structure of FIG. 1.
Figure 3:
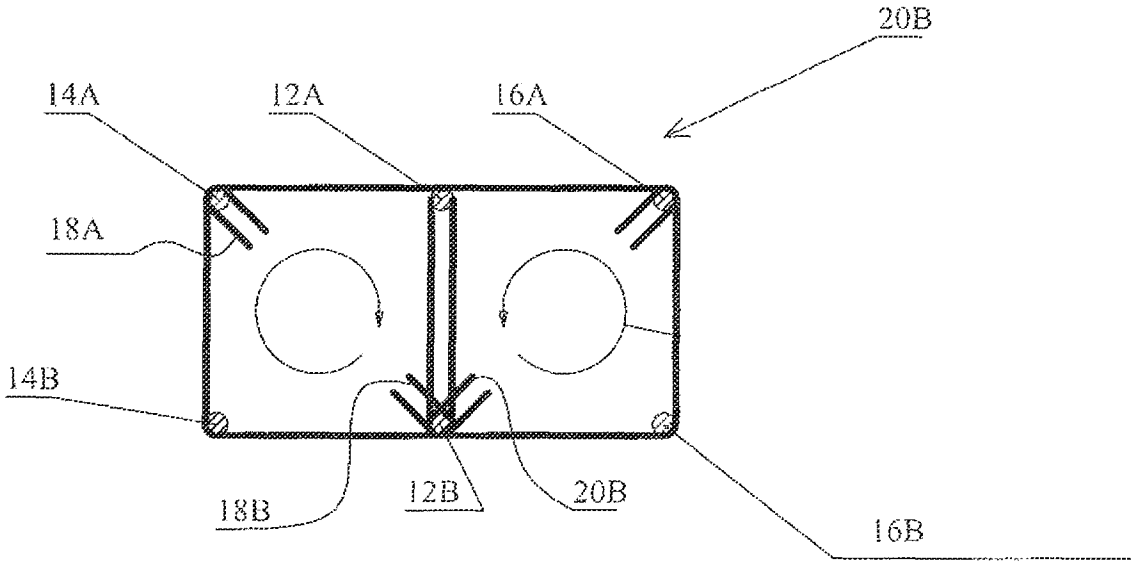
FIG. 3 is a schematic sectional view of the steel reinforcing structure of FIG. 1.

As shown in FIGS. 1 to 3 there is a steel reinforcing structure 10 for concrete (not shown) according to an embodiment of the present invention. The steel reinforcing structure is in the form of a cage 10 to be embedded in cast concrete (not shown). The steel reinforcing cage 10 is embedded in cast concrete to form a structural member including a column, pier, arch, beam, truss, floor, ceiling or wall.

In this embodiment the steel reinforcing cage 10 comprises six (6) reinforcing bars arranged substantially parallel to one another including a pair of common reinforcing bars 12A and 12B located intermediate two (2) pairs of opposing reinforcing bars 14A/14B and 16A/16B. The reinforcing cage 10 also comprises a plurality of spiral ties including one pair of spiral ties 18A and 18B located on one side of the reinforcing cage 10, and another pair of spiral ties 20A and 20B located on an opposite side of the reinforcing cage 10. As viewed in FIG. 3 the pair of spiral ties 18A/18B on the left hand side of the reinforcing cage 10 are formed in a clockwise direction whereas the other pair of spiral ties 20A/20B on the right hand side of the reinforcing cage 10 are formed in an anticlockwise direction forming a set of the spiral ties. This opposing orientation of the spiral ties such as 18A and 20A is understood to balance loads and stresses in the reinforcing cage 10 which may otherwise twist or distort.

As best seen in FIG. 1 the reinforcing cage 10 of this example includes a repeating sequence of the set of spiral ties such as 18A along the reinforcing bars such as 14A. Each set of spiral ties from the repeating sequence includes four (4) spiral ties in the form of two pairs of spiral ties 18A/18B and 20A/20B. Each of the spiral ties such as 18A is formed around the reinforcing cage 10 in a single revolution only. Each of the pair of spiral ties such as 18A and 18B is at one end connected to one of the reinforcing bars 14A and the common reinforcing bar 12B respectively, and at an opposite end connected to the same reinforcing bar at a position offset longitudinally from its connection at said one end. In this embodiment the spiral ties such as 18A and 18B are connected to the reinforcing bar 14A and 12B respectively at longitudinal positions laterally opposite one another. The spiral ties such as 18A and 18B at their opposite ends are also connected to the respective reinforcing bars 14A and 12B at longitudinal positions laterally opposing one another. The spiral ties such as 20A and 20B on the opposite side of the reinforcing cage 10 are, either side of the common reinforcing bars 12A and 12B, effectively a mirror image of the spiral ties 18A and 18B.

As shown in FIG. 1 the clockwise oriented spiral tie such as 18A is connected to the reinforcing bar 14A at a first position 22A. This spiral tie 18A is bent or twisted in the clockwise direction about the pair of common reinforcing bars 12A and 12B and reconnects to the reinforcing bar 14A at another position 24A offset longitudinally from the first position 22A. The opposing anticlockwise oriented spiral 20A is connected to the other reinforcing bar 16A at a second position 26A. This opposing spiral tie 20A is bent or twisted in the anticlockwise direction about the pair of common reinforcing bars 12A and 12B and then reconnected to the other reinforcing bar 16A at a further position 28A offset longitudinally from the second position 26A. In this embodiment the first and second positions 22A and 26A are located laterally opposite one another. The spiral ties such as 18A and 20A are of substantially the same length wherein their respectively offset positions 24A and 28A are also located laterally opposite one another.

In this embodiment the clockwise oriented spiral tie 18A is one of the pair of spiral ties 18A and 18B, and the anticlockwise oriented spiral tie 20A is one of the pair of anticlockwise oriented spiral ties 20A and 20B. The other of the pair of spiral ties 18B and 20B is connected to the common reinforcing bar 12B at a third and fourth position 30A and 32A respectively. The third and fourth positions 30A and 32A are laterally opposite the first and second positions 22A and 26A respectively. In this example the third and fourth positions 30A/32A are substantially the same. The offset positions 34A and 36A at which the respective spiral ties 18B and 20B reconnect to the common reinforcing bar 12A are also substantially the same. The clockwise oriented spiral ties 18A and 18B are thus a mirror image of the anticlockwise oriented spiral ties 20A and 20B. This symmetry and opposing orientation either side of the common reinforcing bars 12A and 12B is understood to balance loads and forces within the reinforcing cage 10.

Figure 4:
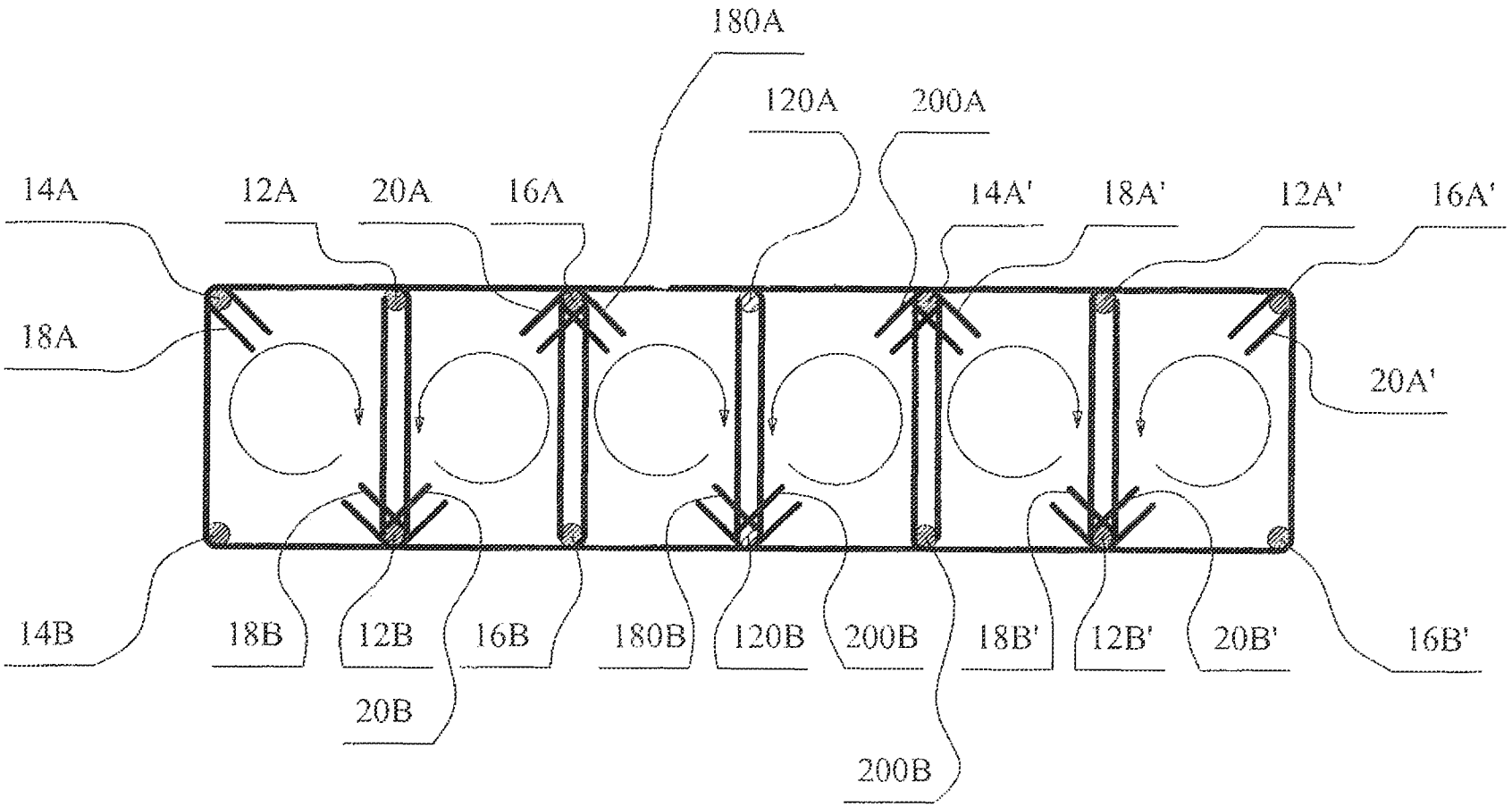
FIG. 4 is a schematic sectional view of another embodiment of a steel reinforcing structure for concrete according to the invention.

FIG. 4 shows another embodiment of a steel reinforcing structure 100 where the reinforcing cage has been extended to include additional reinforcing bars. The reinforcing cage 10 is effectively two (2) of the reinforcing cages 10 and 10' of the previous embodiment with an additional two (2) intermediate reinforcing bars 120A and 120B. In a similar manner to the previous embodiment of the reinforcing cage 10, the two (2) reinforcing cages 10 and 10' are interconnected by a pair of clockwise-oriented spiral ties 180A/180B on one side of the intermediate reinforcing bars 120A/120B, and a pair of anticlockwise oriented spiral ties 200A/200B on an opposite side of the intermediate bars 120A/120B. The reinforcing cage 100 thus consists of 14 reinforcing bars arranged in two rows with each row having seven (7) reinforcing bars. This reinforcing cage 100 may be used in a cast concrete structure having relatively high load areas. For ease of reference and to avoid repetition, similar components from the previous embodiment of the reinforcing cage 10 have been indicated with the same reference numeral.

Figure 5:
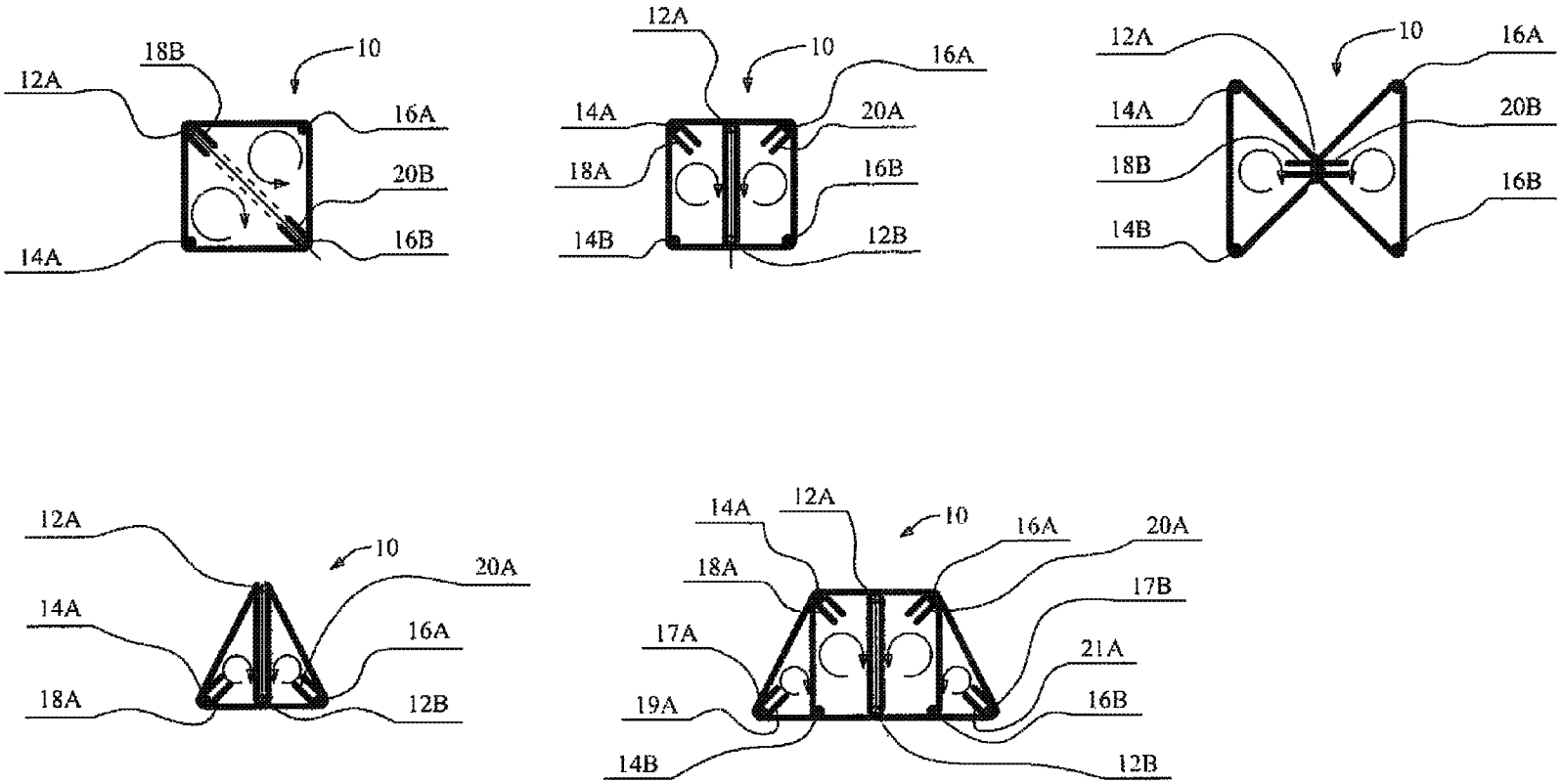
FIG. 5 are schematic sectional views of variations on the steel reinforcing structure for concrete according to different embodiments of the invention.

FIG. 5 illustrates five other embodiments of the steel reinforcing structure. Each of these embodiments includes at least one common reinforcing bar located intermediate a pair of opposing reinforcing bars. With the exception of embodiment (c) the reinforcing cages each include a pair of the common reinforcing bars. The embodiment of (c) has a single common reinforcing bar with a pair of reinforcing bars. located either side of it to form a reinforcing cage having two triangular-shapes with their apexes connected. The embodiments of (a) and (b) are square-shaped in profile where in (a) the pair of common bars locate diagonally opposite one another as do the pair of other reinforcing bars. In the embodiment of (b) the two pairs of reinforcing bars define corners of the square-shaped profile with the pair of common bars bisecting the square profile. The embodiment of (d) is triangular-shaped in profile with each of its corners defined by one of the pair of common reinforcing bars and the pair of other reinforcing bars. The embodiment of (e) is trapezium-shaped in profile having a total eight reinforcing bars with three in an upper row and five in a lower row Where the outermost of the reinforcing bars in the upper and lower rows define the corners of the trapezium. The pair of common reinforcing bars in the trapezium-shaped cage of (e) effectively bisect the cage with the other reinforcing bars located on opposite sides of the cage. For ease of reference and to avoid repetition, similar components from the previous embodiment of the reinforcing cage 10 have been indicated With the same reference numeral. The additional pair of reinforcing bars of the embodiment of (e) have been referenced 17A and 17B.

Each of the reinforcing cages of FIG. 5 includes clockwise and anticlockwise oriented spiral ties such as 18A and 20A interconnecting the common reinforcing bar 12A and the pair of opposing reinforcing bars 14A and 16A in a similar manner to the earlier embodiments. It will be appreciated that variations on the various shapes of these alternative embodiments may exist which are still considered within the scope of the invention. The invention is not limited to steel reinforcing structures of a particular shape but rather extends to steel reinforcing structures having reinforcing bars and spiral ties of an opposite directional orientation as for example described in the context of the previous embodiments.

Figure 6:
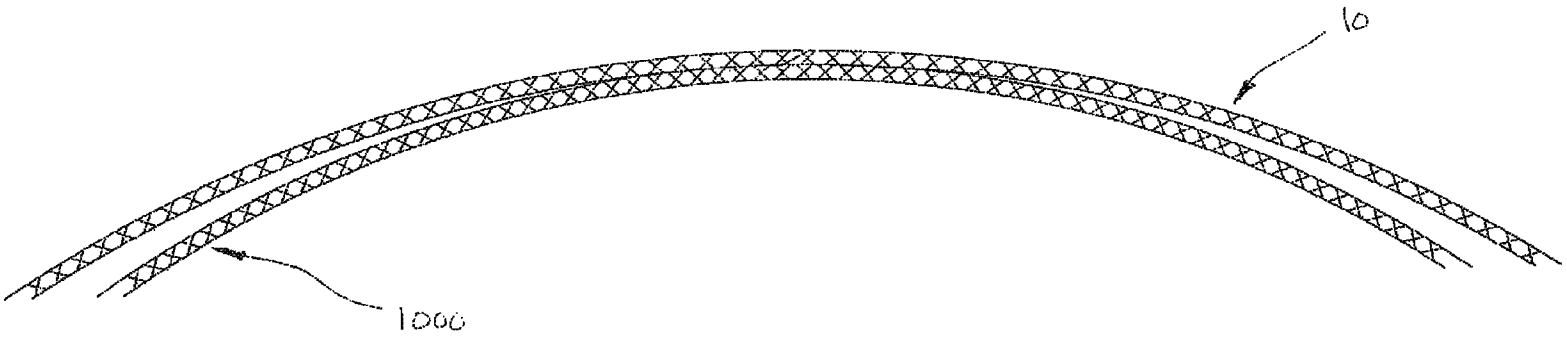
FIG. 6 is a schematic side view of a pair of the steel reinforcing cages such as that illustrated in FIG. 2.

FIG. 6 illustrates an application of the invention utilising a pair of steel reinforcing structures such as that illustrated in FIG. 2. The pair of reinforcing cages 10 and 10' are essentially identical to each other except a lower of the cages 1000 has a smaller radius (or greater curvature) compared to the upper reinforcing cage 10. The reinforcing cages 10 and 1000 when embedded in cast concrete provide a suitable arch, beam or truss for supporting high loads. It will be understood that the steel reinforcing structure of this and earlier embodiments is intended to locate within either temporary or permanent formwork (not shown) designed to allow embedding of the reinforcing structure or cage in cast concrete.

The invention in another aspect is directed to a method of forming a steel reinforcing structure for concrete, such as the reinforcing cage 10 of the earlier embodiments. The general steps involved in forming the steel reinforcing cage 10 of the earlier embodiment are as follows:

1. A pair of common reinforcing bars 12A/12B are located parallel to one another and intermediate two (2) pairs of opposing reinforcing bars 14A/14B and 16A/16B;
2. The reinforcing bars such as 12A are interconnected by:
   (a) connecting a spiral tie 18A at one end to one of the pair of reinforcing bars 14A at a first position 22A;
   (b) forming the spiral tie 18A in a clockwise direction around the common reinforcing bars 12A and 12B and the other of the reinforcing bars 14B;
   (c) connecting the spiral tie 18A at an opposite end to the reinforcing bar 14A at another position 24A offset longitudinally from the first position 22A;
   (d) connecting an other spiral tie 20A at one end to one of the other pair of reinforcing bars 16A at a second position 26A;
   (e) forming the other spiral tie 20A in an anticlockwise direction around the common reinforcing bars 12A and 12B and the other of the reinforcing bars 16B;
   (f) connecting the other spiral tie 20A at an opposite end to the reinforcing bar 16A at a further position 28A offset longitudinally from the second position 26A.

The reinforcing cage 10 includes a pair of both the clockwise oriented spiral ties such as 18A and the anticlockwise oriented spiral ties such as 20A. The other spiral tie of the pair of spiral ties 18B and 20B is similarly formed about the reinforcing cage 10 but connected at one end and reconnected at an opposite end to the common reinforcing bar such as 12B rather than one of the opposing pair of reinforcing bars such as 14A.

The spiral ties such as 18A may be connected to the reinforcing bar in steps (a), (c), (d) and (f) by welding. Alternatively the spiral ties may be bent, crimped, wired or chemically bonded to the reinforcing bar, in addition to connection of the spiral ties at each of its opposite ends, the spiral tie may at various positions along its length connect to other reinforcing bars in the reinforcing cage. These other connections can similarly be made by welding, bending, crimping, wiring or chemically bonding.

Now that several preferred embodiments of the invention have been described in some detail it will be apparent to those skilled in the art that the steel reinforcing structure for concrete has at least the following advantages:

1. The structure is designed to remain relatively stable in either a static or loaded condition without any significant twisting or distortion of the reinforcing structure;
2. The reinforcing structure can be fabricated or formed from existing or conventional materials such as reinforcing steel;
3. The reinforcing structure can be prefabricated or constructed in-situ;
4. The reinforcing structure lends itself to placement in formwork for embedding in cast concrete.

Those skilled in the art will appreciate that the invention described herein is susceptible to variations and modifications other than those specifically described. For example, the specific number and layout of reinforcing bars may vary provided they are interconnected with clockwise and anticlockwise oriented spiral ties. The steel reinforcing structure for concrete is also not limited to any particular application and may extend beyond those applications disclosed in this specification. All such variations and modifications are to be considered within the scope of the present invention the nature of which is to be determined from the foregoing description.

The invention claimed is:

1. A steel reinforcing structure for concrete, said structure comprising:

at least a pair of opposing reinforcing bars arranged substantially parallel to one another;

at least one common reinforcing bar located intermediate and substantially parallel to the pair of opposing reinforcing bars;

a spiral tie at one end connected to one of the pair of opposing reinforcing bars at a first position, the spiral tie being formed and bent, in a clockwise direction, around each of the at least one common reinforcing bar to connect at an opposite end of the spiral tie to said one of the pair of opposing reinforcing bars at an other position offset longitudinally from said first position, such that the spiral tie follows a first substantially spiral and non-orthogonal path and forming an angle around the pair of opposing reinforcing bars and the at least one common reinforcing bar;

an other spiral tie at one end connected to the other of the pair of opposing longitudinal reinforcing bars at a second position, the other spiral tie being formed and bent, in an anticlockwise direction, around each of the at least one common reinforcing bar to connect at an opposite end of the other spiral tie to said other of the pair of opposing reinforcing bars at a further position offset longitudinally from said second position, such that the other spiral tie follows a second substantially spiral and non-orthogonal path and forming an angle around the pair of opposing reinforcing bars and the at least one common reinforcing bar.

2. A reinforcing structure as defined in claim 1 also comprising a further spiral tie at one end connected to the at least one common reinforcing bar at a third position laterally opposite the first position and formed in the clockwise direction around said one of the pair of reinforcing bars to connect at an opposite end of the further spiral tie to said at least one common reinforcing bar at yet another position offset longitudinally from the third position.

3. A reinforcing structure as defined in claim 2 wherein the other position is laterally opposite said yet another position.

4. A reinforcing structure as defined in claim 1 further comprising yet another spiral tie at one end connected to the at least one common reinforcing bar at a fourth position laterally opposite the second position and formed in the anticlockwise direction around the other of the pair of reinforcing bars to connect at an opposite end of said yet another spiral tie to said at least one common reinforcing bar at still a further position offset longitudinally from the fourth position.

5. A steel reinforcing structure for concrete, said structure comprising:

at least a pair of opposing reinforcing bars arranged substantially parallel to one another;

at least one common reinforcing bar located intermediate and substantially parallel to the pair of opposing reinforcing bars;

a spiral tie at one end connected to the at least one common reinforcing bar at a first position and formed and bent to follow a first substantially spiral and non-orthogonal path in a clockwise direction and forming an angle around one of the opposing pair of reinforcing bars to connect at an opposite end of the spiral tie to the at least one common reinforcing bar at another an other position offset longitudinally from the first position; and an other spiral tie at one end connected to the at least one common reinforcing bar at a second position and formed and bent to follow a second substantially spiral and non-orthogonal path in an anticlockwise direction and forming an angle around the other of the opposing pair of reinforcing bars to connect at an opposite end of the other spiral tie to the at least one common reinforcing bar at a further position offset longitudinally from the second position.

6. A reinforcing structure as defined in claim 5 further comprising a further spiral tie at one end connected to said one of the opposing pair of reinforcing bars at a third position laterally opposite the first position and formed in the clockwise direction around the at least one common reinforcing bar to connect at an opposite end of the further spiral tie to said one of the pair of reinforcing bars at yet another position offset longitudinally from the third position.

7. A reinforcing structure as defined in claim 6 wherein the other position is laterally opposite said yet another position.

8. A reinforcing structure as defined in claim 5 further comprising yet another spiral tie at one end connected to said other of the opposing pair of reinforcing bars at a fourth position laterally opposite the second position and formed in the anticlockwise direction around the at least one common reinforcing bar to connect at an opposite end of said yet another spiral tie to said other of the pair of the reinforcing bars at still a further position offset longitudinally from the fourth position.

9. A reinforcing structure as defined in claim 1 wherein the spiral ties each form about the at least one common reinforcing bar and either one or the other of the opposing pair of reinforcing bars in a single rotation.

10. A reinforcing structure as defined in claim 1 wherein the first position at which the spiral tie is connected to either said one of the pair of reinforcing bars or the at least one common reinforcing bar is substantially the same as the second position at which the other spiral tie is connected to either the other of the pair of reinforcing bars or the at least one common reinforcing bar.

11. A reinforcing structure as defined in claim 8 wherein the third position is substantially the same as the fourth position.

12. A reinforcing structure as defined in claim 1 wherein the other position is substantially the same as the further position.

13. A reinforcing structure as defined in claim 8 wherein said yet another position is laterally opposite said still a further position.

14. A reinforcing structure as defined in claim 1 wherein each of the pair of opposing reinforcing bars is one of two reinforcing bars arranged substantially parallel to one another, and the at least one common reinforcing bar is one of two common reinforcing bars also arranged substantially parallel to one another.

15. A reinforcing structure as defined in claim 14 wherein the two reinforcing bars from each of the pairs are equally spaced laterally from and substantially aligned with the two common reinforcing bars.

16. A reinforcing structure as defined in claim 14 wherein the at least one common reinforcing bar is one of two common reinforcing bars arranged substantially parallel to one another, and each of the pair of opposing reinforcing bars is a single reinforcing bar equally spaced laterally from the two common reinforcing bars.

17. A reinforcing structure as defined in claim 16 wherein the single reinforcing bars are equally spaced laterally from and substantially aligned with only one of the two common reinforcing bars.

18. A reinforcing structure as defined in claim 1 wherein the at least one common reinforcing bar is a single common reinforcing bar, and each of the pair of opposing reinforcing bars is one of two reinforcing bars arranged substantially parallel to one another and equally spaced laterally from the single common reinforcing bar.

19. A reinforcing structure as defined in claim 1 wherein the spiral ties are each one of a plurality of spiral ties spaced longitudinally along respective of either said one or the other of the pair of reinforcing bars, and the at least one common reinforcing bar.

20. A reinforcing structure as defined in claim 19 wherein each of the plurality of spiral ties forms about the at least one common reinforcing bar and either one or the other of the opposing pair of reinforcing bars in a single rotation.

21. A method of forming a steel reinforcing structure for concrete, said method comprising the steps of:

providing at least a pair of opposing reinforcing bars arranged substantially parallel to one another;

providing at least one common reinforcing bar located intermediate and substantially parallel to the pair of opposing reinforcing bars;

interconnecting the pair of opposing reinforcing bars and the at least one common reinforcing bar by:

i) connecting a spiral tie at one end to one of the pair of opposing reinforcing bars, or the at least one common reinforcing bar, at a first position;

ii) forming and bending the spiral tie in a clockwise direction around each of the at least one common reinforcing bar, or said one of the pair of opposing reinforcing bars;

iii) connecting the spiral tie at an opposite end to said one of the pair of opposing reinforcing bars, or the at least one common reinforcing bar, at an other position offset longitudinally from the first position, such that the spiral tie follows a first substantially spiral and non-orthogonal path and forming angle around the pair of opposing reinforcing bars or the at least one common reinforcing bar:

iv) connecting an other spiral tie at one end to the other of the pair of opposing reinforcing bars, or the at least one common reinforcing bar, at a second position;

v) forming and bending the other spiral tie in an anticlockwise direction around each of the at least one common reinforcing bar, or the other of the pair of opposing reinforcing bars;

vi) connecting the other spiral tie at an opposite end to said other of the pair of opposing reinforcing bars, or the at least one common reinforcing bar, at a further position offset longitudinally from the second position, such that the other spiral tie follows a second substantially spiral and non-orthogonal path and forming an angle around the pair of opposing reinforcing bars or the common reinforcing bar.

22. A method as defined in claim 21 wherein the step of connecting the spiral tie or the other spiral tie involves welding said spiral tie to either one of the pair of opposing reinforcing bars or the at least one common reinforcing bar.

23. A method as defined in claim 22 wherein this connecting step involves bending or crimping said spiral tie to secure it to either one of the pair of reinforcing bars or the at least one common reinforcing bar.

24. A method as defined in claim 21 wherein the spiral tie is wired or chemically bonded to said one of the reinforcing bars or the at least one common reinforcing bar.

25. A reinforcing structure as defined in claim 1, wherein the first and the other position are offset from one another by more than twice a width of the first spiral tie.

26. A reinforcing structure as defined in claim 5, wherein the first position and the other position are offset from one another by more than twice a width of the spiral tie.

27. A method as defined in claim 21, wherein the first position and the other position are offset from one another by more than twice a width of the spiral tie.

* * * * *